US007757670B2

(12) United States Patent
Yamada et al.

(10) Patent No.: US 7,757,670 B2
(45) Date of Patent: Jul. 20, 2010

(54) FUEL SUPPLY SYSTEM FOR GENERAL PURPOSE ENGINE

(75) Inventors: Yoshikazu Yamada, Saitama (JP); Shigeru Saito, Saitama (JP); Keiichiro Bungo, Saitama (JP); Yasunori Matsubara, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 353 days.

(21) Appl. No.: 11/891,764

(22) Filed: Aug. 13, 2007

(65) Prior Publication Data

US 2008/0041464 A1 Feb. 21, 2008

(30) Foreign Application Priority Data

Aug. 16, 2006 (JP) ..... 2006-222086
Aug. 16, 2006 (JP) ..... 2006-222087

(51) Int. Cl.
*F02M 37/04* (2006.01)
*F01P 1/06* (2006.01)

(52) U.S. Cl. ..... 123/509; 123/41.31; 123/514

(58) Field of Classification Search ..... 123/497, 123/509, 514, 516, 41.01, 41.56, 41.31
See application file for complete search history.

(56) References Cited

U.S. PATENT DOCUMENTS 5,103,793 A * 4/1992 Riese et al. ..... 123/516
5,309,885 A * 5/1994 Rawlings et al. ..... 123/509
5,375,578 A * 12/1994 Kato et al. ..... 123/516
5,404,858 A * 4/1995 Kato ..... 123/516
5,647,331 A * 7/1997 Swanson ..... 123/516
5,797,378 A * 8/1998 Kato ..... 123/516
5,855,197 A * 1/1999 Kato ..... 123/516
5,865,160 A * 2/1999 Kato ..... 123/516
5,890,472 A * 4/1999 Saito ..... 123/516
5,915,363 A * 6/1999 Iwata et al. ..... 123/497
6,055,962 A * 5/2000 Kirk ..... 123/516
6,257,208 B1 * 7/2001 Harvey ..... 123/516
6,408,835 B1 * 6/2002 Katayama et al. ..... 123/572
6,422,204 B1 7/2002 Sinz
6,527,603 B1 * 3/2003 Wickman et al. ..... 440/88 F
6,679,229 B2 * 1/2004 Wada et al. ..... 123/516
6,698,401 B2 * 3/2004 Suzuki et al. ..... 123/516

(Continued)

FOREIGN PATENT DOCUMENTS

DE 19942548 3/2001

(Continued)

*Primary Examiner*—Thomas N Moulis
(74) *Attorney, Agent, or Firm*—Carrier, Blackman & Associates P.C.; William D. Blackman; Joseph P. Carrier

(57) ABSTRACT

A fuel supply system for a general purpose internal combustion engine is equipped with a sub-fuel tank that retains gasoline fuel supplied from a main fuel tank and houses the high-pressure pump in its interior. In other words, the pump is immersed in the gasoline fuel retained in the tank, so that if an air pocket should occur in the fuel supply pipe between the main fuel tank and pump, the air will be discharged from the sub-fuel tank to the exterior through a fuel return pipe etc., thereby ensuring that the pump does not suck in air. Since fuel injectors can therefore inject gasoline fuel immediately, starting performance is enhanced.

18 Claims, 10 Drawing Sheets

U.S. PATENT DOCUMENTS

| | | | | |
|---|---|---|---|---|
| 6,739,318 | B2 * | 5/2004 | Nomura | 123/461 |
| 7,216,614 | B2 * | 5/2007 | Shibata et al. | 123/179.17 |
| 2002/0040706 | A1 * | 4/2002 | Katayama et al. | 123/516 |
| 2003/0062031 | A1 | 4/2003 | Tanimura | |
| 2004/0003796 | A1 * | 1/2004 | Nomura | 123/461 |
| 2007/0266762 | A1 | 11/2007 | Rumpf | |

FOREIGN PATENT DOCUMENTS

| | | | |
|---|---|---|---|
| EP | 1 300 582 | A2 | 4/2003 |
| EP | 1 300 582 | A3 | 8/2004 |
| JP | 02-185667 | | 7/1990 |
| WO | WO 2006/034937 | A1 | 4/2006 |

* cited by examiner

FUEL SUPPLY SYSTEM FOR GENERAL PURPOSE ENGINE

CROSS-REFERENCE TO RELATED APPLICATIONS

The present application claims priority under 35 USC §119 based on Japanese patent application No. 2006-222086 and 2006-222087, both filed on Aug. 16, 2006. The entire subject matter of each of these priority documents is incorporated by reference herein.

BACKGROUND OF THE INVENTION

1. Field of the Invention

This invention relates to a fuel supply system for a general purpose internal combustion engine.

2. Description of the Related Art

The general purpose internal combustion engines used as prime movers in power generators, agricultural machines and various other applications have generally used a carburetor to supply fuel to the engine. In recent years, however, systems have been developed for such engines that supply fuel by means of a fuel pump and fuel injectors, i.e., by means of an FI (Fuel Injection) type fuel supply system, as, for example, disclosed in Japanese Laid-Open Patent Application No. Hei 2 (1990)-185667, particularly on page 2, lower right column, and FIG. 1.

When, as taught by the reference, the fuel pump is installed or interposed in the fuel supply pipe connecting the fuel tank with the fuel injectors, air entrainment may occur at the fuel pump if air enters and is trapped in the fuel supply pipe between the fuel tank and the fuel pump. When this happens, the fuel injectors do not inject fuel immediately, which may cause poor starting performance and other problems. Moreover, since water, foreign matter and other impurities contained in the fuel pass through the fuel pump without being removed, they are liable to cause fuel pump breakdown.

SUMMARY OF THE INVENTION

An object of this invention is therefore to overcome the foregoing problems by providing a fuel supply system for a general purpose internal combustion engine that improves starting performance by enabling the fuel injectors to inject fuel immediately even when pockets of trapped air arise in the fuel supply pipe and that inhibits direct supply of impurities in the fuel to the fuel pump.

In order to achieve the object, this invention provides a fuel supply system for a general purpose internal combustion engine, comprising: a fuel tank adapted to retain fuel of the engine; a fuel injection unit including a fuel injector to inject the fuel into an intake port of a cylinder of the engine; a fuel supply pipe connecting the fuel tank and the fuel injection unit; a fuel pump installed in the fuel supply pipe to pump and supply the fuel to the fuel injection unit; and a sub-fuel tank adapted to retain the fuel supplied from the fuel tank, such that the fuel pump is housed in the sub-fuel tank.

BRIEF DESCRIPTION OF THE DRAWINGS

The above and other objects and advantages of the invention will be more apparent from the following description and drawings in which.

DETAILED DESCRIPTION OF THE PREFERRED EMBODIMENTS

Preferred embodiments for implementing the fuel supply system for a general purpose internal combustion engine according to this invention will now be explained with reference to the attached drawings.

Figure 1:
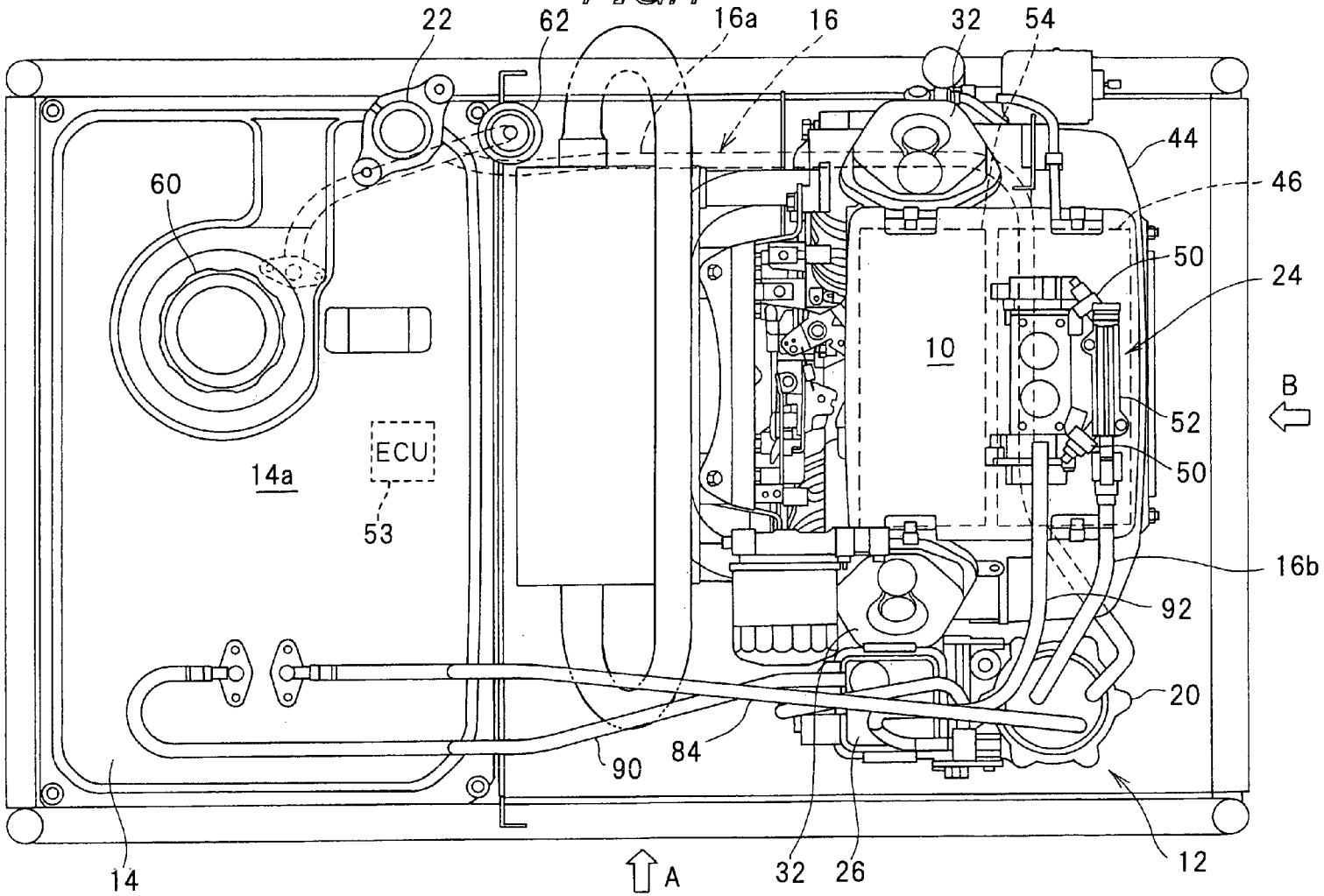
FIG. 1 is a partially cutaway plan view of a general purpose engine equipped with a fuel supply system according to a first embodiment of this invention.
Figure 2:
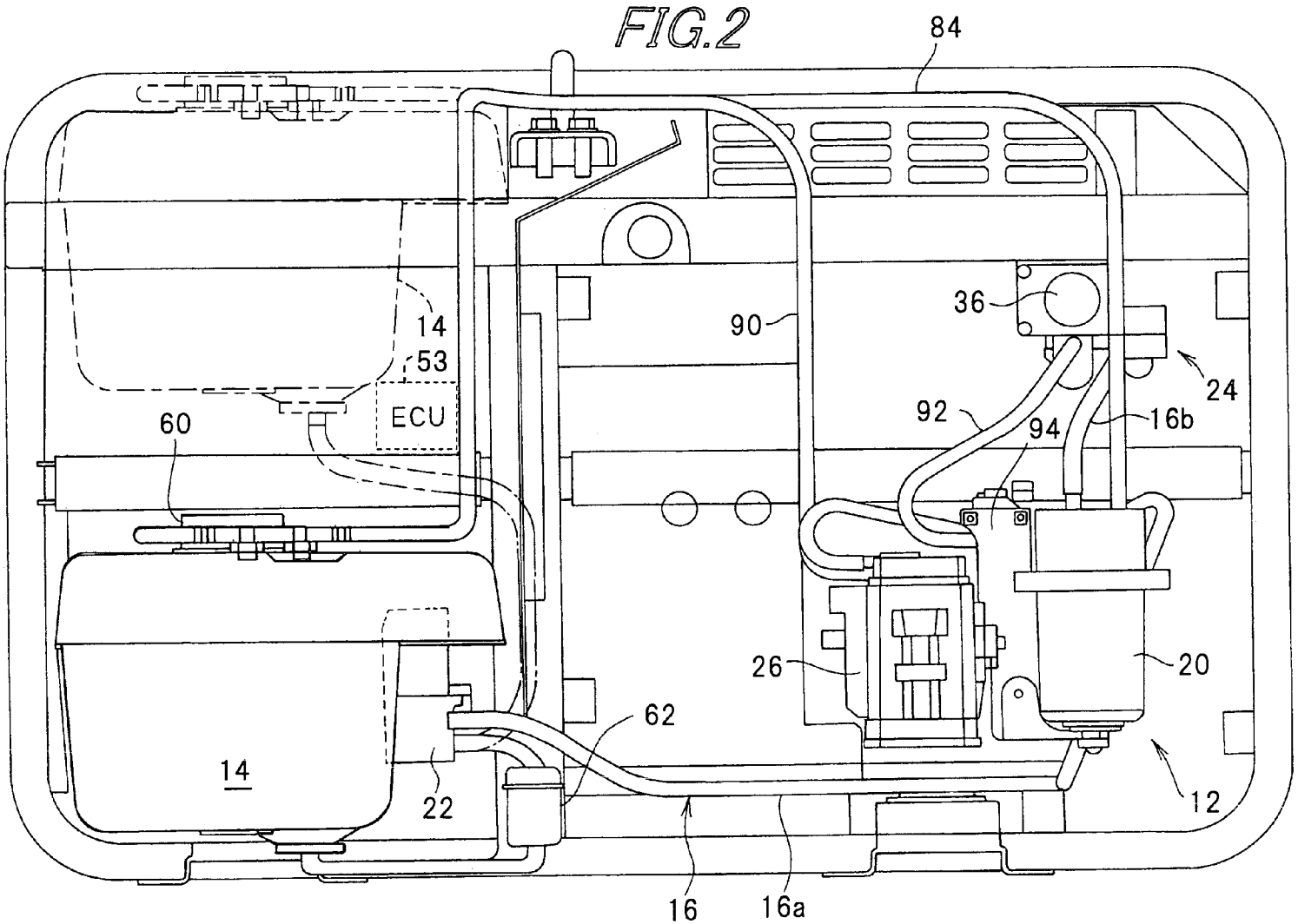
FIG. 2 is a partially cutaway side view of the fuel supply system of the engine seen in the direction of the arrow A in FIG. 1.
Figure 3:
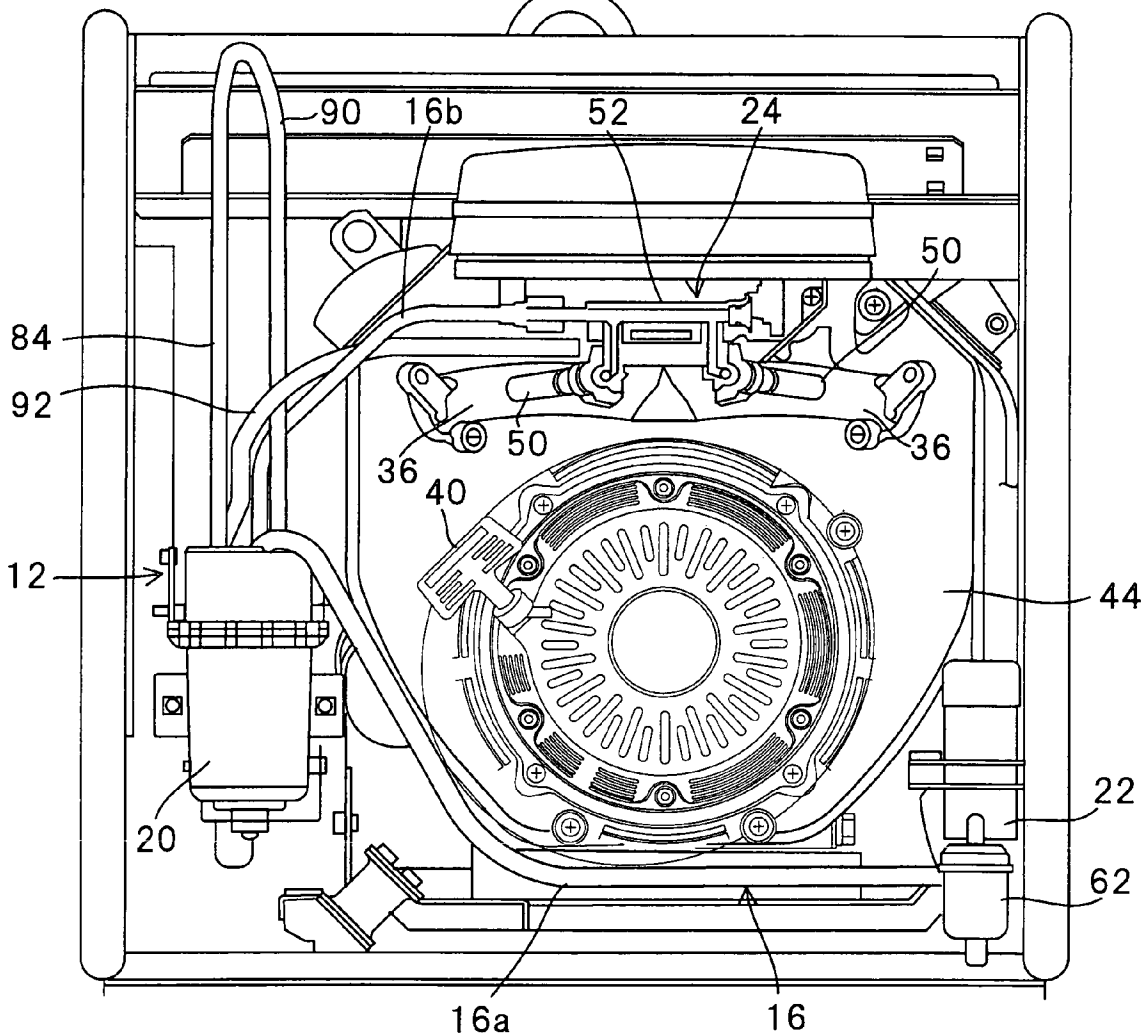
FIG. 3 is a partially cutaway side view of the fuel supply system of the engine seen in the direction of the arrow B in FIG. 1.

FIG. 1 is a partially cutaway plan view of a general purpose engine equipped with a fuel supply system according to a first embodiment of this invention. FIG. 2 is a partially cutaway side view of the fuel supply system for a general purpose internal combustion engine seen in the direction of the arrow A in FIG. 1. FIG. 3 is a partially cutaway side view of the fuel supply system seen in the direction of the arrow B in FIG. 1. To make the fuel supply system easier to understand, only part of the general purpose engine is shown in FIGS. 2 and 3.

Symbol 10 in FIG. 1 designates the general purpose internal combustion engine. In the depicted embodiment, the engine 10 is an air-cooled, two-cylinder, four-cycle, spark-ignition, gasoline engine that can be used as a prime mover in power generation equipment, agricultural machinery and various other applications. A fuel supply system 12 is connected to the engine 10 for supplying fuel to the engine 10.

The fuel supply system 12 is equipped with, inter alia, a main fuel tank 14 (not visible in FIG. 3) for retaining fuel, a fuel supply pipe or line 16 interconnecting the main fuel tank 14 and the engine 10 (more exactly, fuel injectors (explained later) of the engine 10), a high-pressure pump module 20 installed in the fuel supply pipe 16, a low-pressure pump (second fuel pump) 22 installed in the fuel supply pipe 16 on the upstream side of the high-pressure pump module 20, a fuel injection unit 24 for injecting gasoline fuel, and a canister 26 (not visible in FIG. 3) accommodating an adsorbent for adsorbing fuel vapor released from the main fuel tank 14.

The members constituting the engine 10 and the fuel supply system 12 will now be explained.

Figure 4:
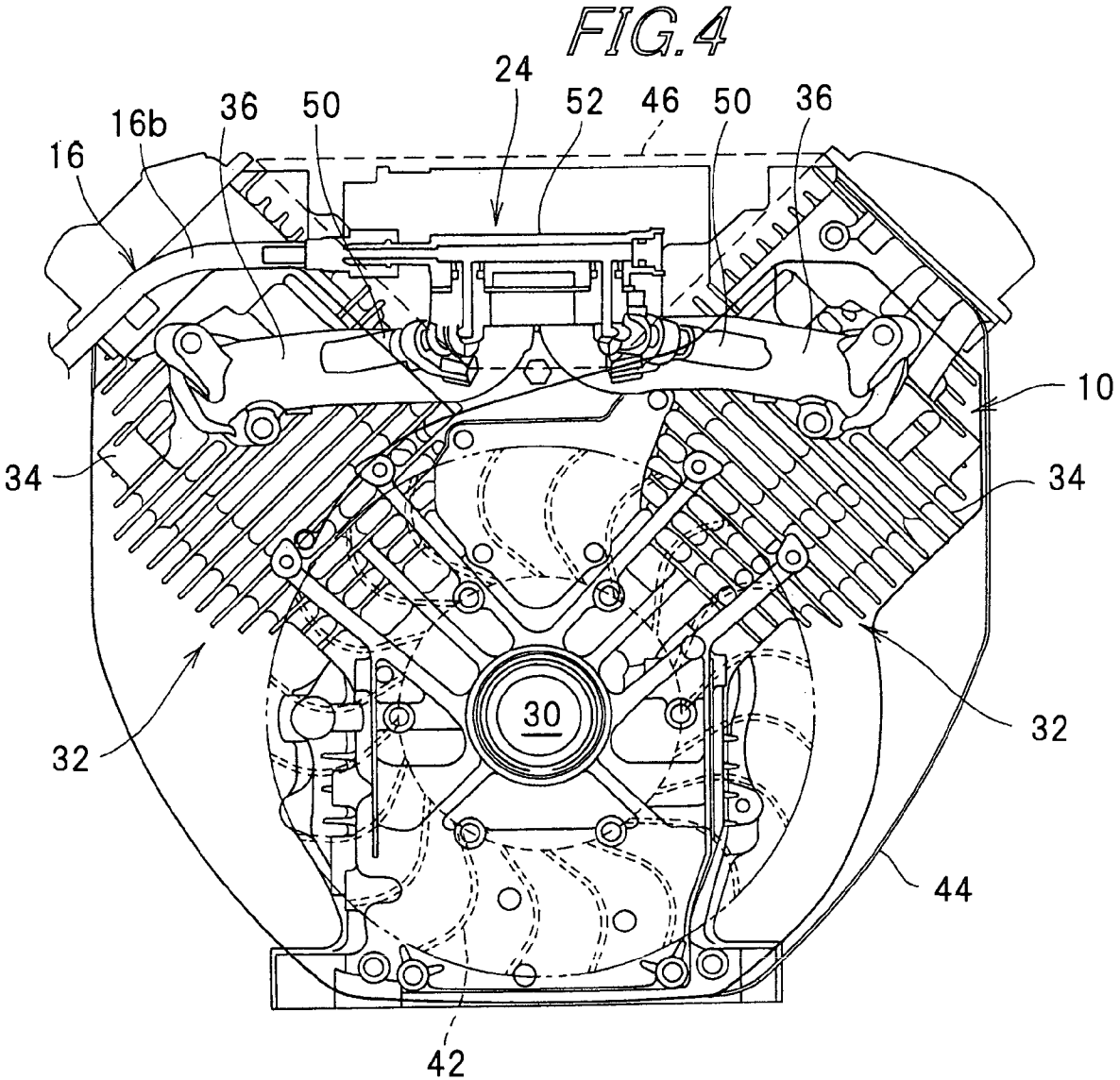
FIG. 4 is a partially cutaway side view of the engine seen in the direction of the arrow B in FIG. 1.

FIG. 4 is a partially cutaway side view of the engine 10 seen in the direction of the arrow B.

As shown in FIG. 4, the engine 10 is equipped with a plurality of, i.e., two cylinders 32 centered on a crankshaft 30 and oriented in a V-like configuration. Pistons (not shown) are accommodated in the cylinders (cylinder block) 32 of the engine 10 so as to be capable of reciprocating. Cylinder heads 34 are fastened to the tops of the cylinders 32. Combustion chambers (not shown) are formed in the cylinder heads 34 at locations facing the piston heads. Intake ports 36 and exhaust ports (not shown) are provided in communication with the combustion chambers.

Further, although not shown in the drawings, the cylinder heads 34 are equipped with, inter alia, intake valves for opening/closing communication between the combustion chambers and the intake ports 36 and exhaust valves for opening/closing communication between the combustion chambers and exhaust ports.

A generator or other load (not shown) is connected to one end of the crankshaft 30. A recoil starter 40 (shown only in FIG. 3) used by the operator to start the engine 10 manually and a cooling fan 42 for cooling the engine 10 by drawing in air and blowing it onto the engine 10 are attached to the other end of the crankshaft 30. The cooling fan 42 is enclosed by a fan cover 44 located adjacent to the cylinders 32.

Figure 5:
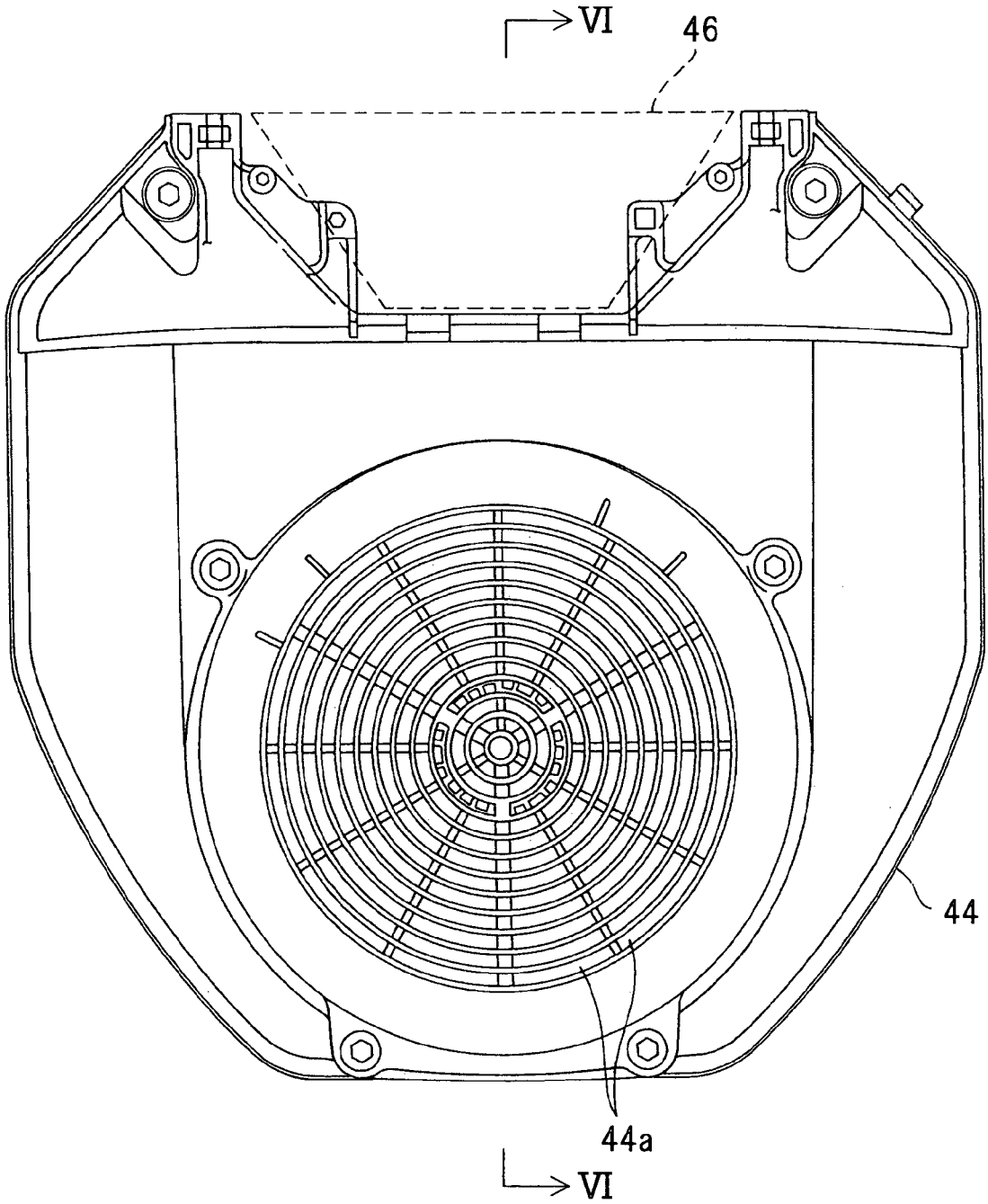
FIG. 5 is a front view of a fan cover shown in FIG. 3.
Figure 6:
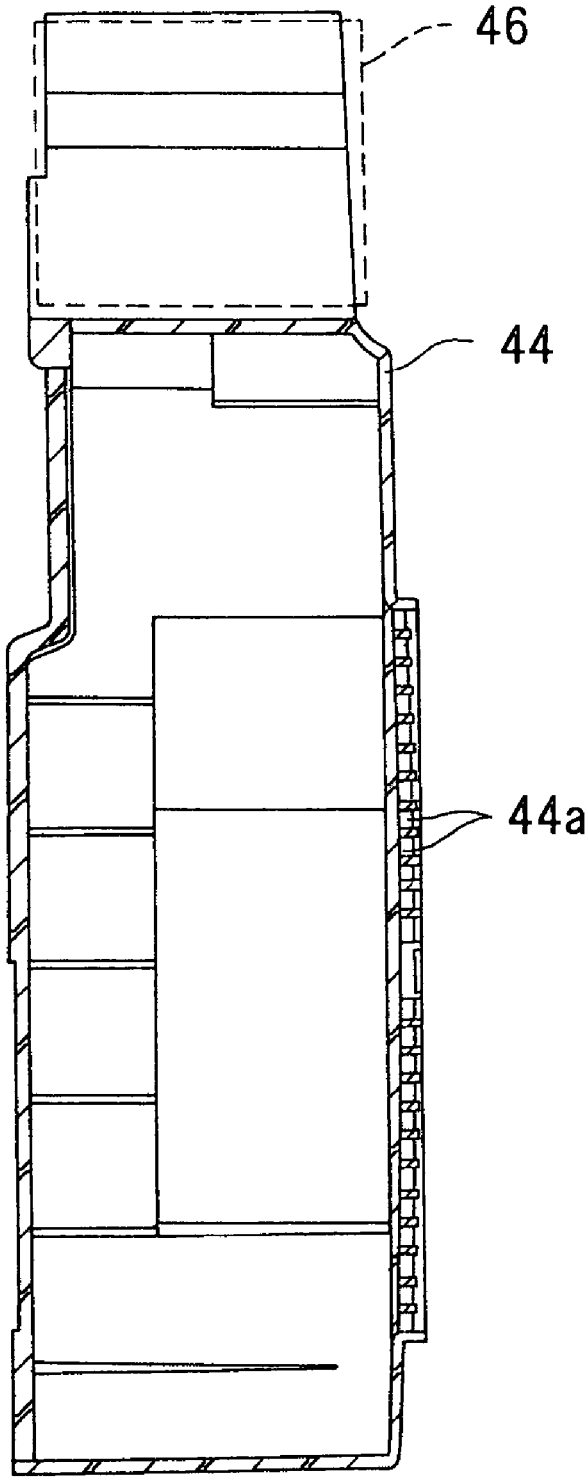
FIG. 6 is a cross-sectional view of the fan cover taken along line VI-VI in FIG. 5.

FIG. 5 is a front view of the fan cover 44 and FIG. 6 is a cross-sectional view of the fan cover 44 taken along line VI-VI in FIG. 5.

As best shown in FIG. 5, the fan cover 44 is shaped to match the engine 10. Namely, its upper region is given a V-like configuration similar to the cylinders 32 of the engine 10. As a result, the top portion of the fan cover 44 defines a V-shaped (trapezoidal) space. This space is hereinafter called the "fan cover upper space". It is indicated in FIG. 5 and other drawings by broken lines and designated by the symbol 46.

The fan cover 44 is fabricated of a material such as resin. The center region of the fan cover 44 positioned near the cooling fan 42 is, as shown in FIGS. 5 and 6, formed with many air intake holes 44*a* through which a flow of cooling air is drawn in.

As shown in FIG. 4, the aforesaid fuel injection unit 24 is installed at a position close to the cooling fan 42, more precisely in the fan cover upper space 46 of the fan cover 44. The fuel injection unit 24 comprises two fuel injector valves (fuel injectors) 50 installed one at each cylinder 32 (more exactly, one near the intake port 36 of each cylinder 32), and a delivery pipe 52 for delivering gasoline fuel from the fuel supply pipe 16 to the fuel injectors 50. The operation of the fuel injectors 50 is controlled by an ECU (Electronic Control Unit; shown in FIG. 1 and other figures) 53 constituted as a microcomputer.

Thus, the fuel injection unit 24 of the engine 10 is installed at a position close to the cooling fan 42, specifically to the fan cover 44, more specifically in the fan cover upper space 46 formed at the upper region of the fan cover 44, and at a position close to the space present between the two cylinders 32 (hereinafter called the "over-cylinder space" and designated by the symbol 54 in FIG. 1). As viewed in FIG. 4, the over-cylinder space 54 is located reward of the fan cover upper space 46 in the direction perpendicular to the drawing sheet. Like the fan cover upper space 46, it has a V-like shape viewed from the side.

Figure 7:
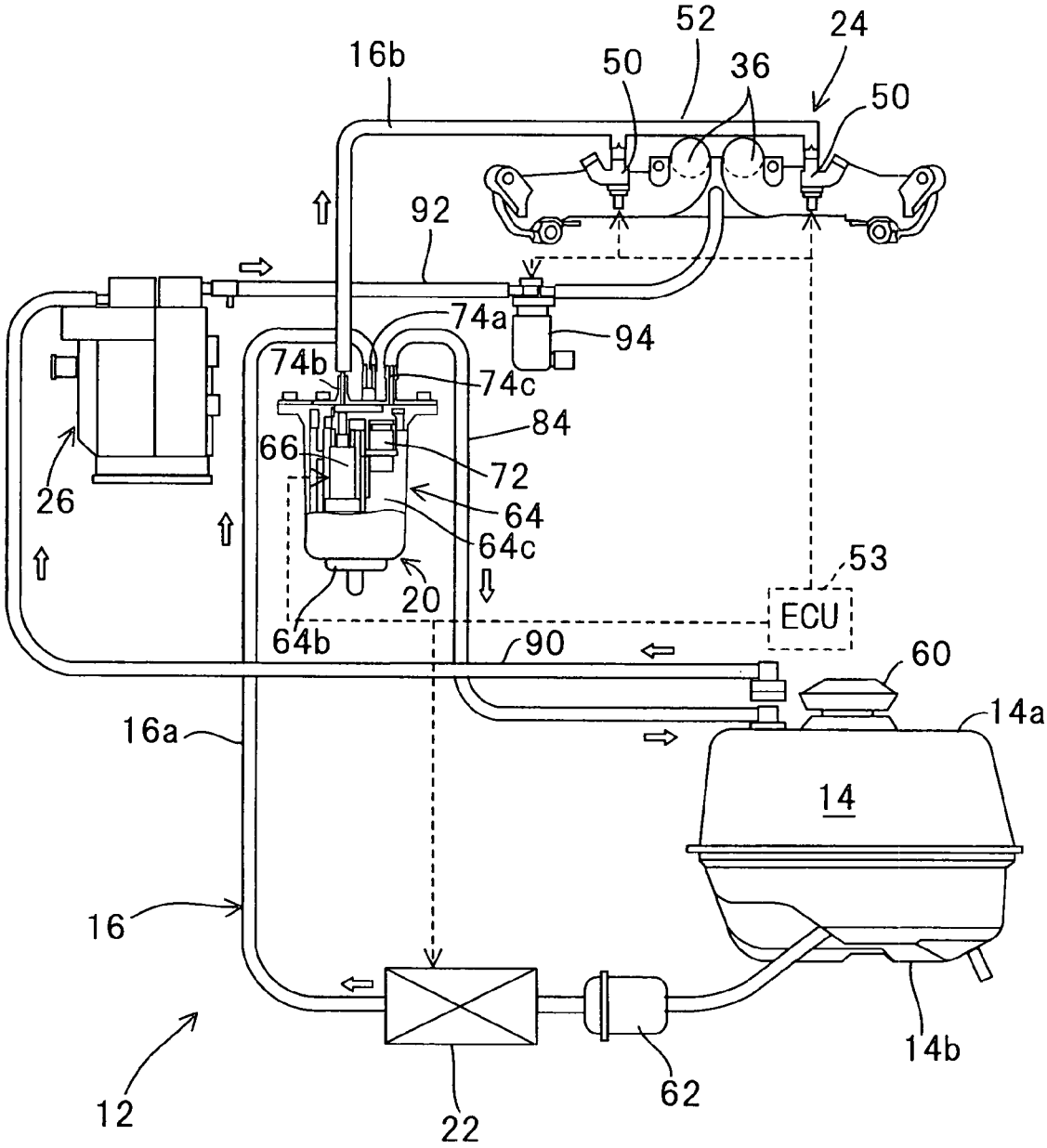
FIG. 7 is a view schematically showing the members constituting the fuel supply system.

FIG. 7 is a view schematically showing the members constituting the fuel supply system 12. In FIG. 7, the constituent members are shown topologically. Upward in the drawing sheet is gravitationally upward.

The main fuel tank 14 contains gasoline fuel for supply to the engine 10. A filler opening (not shown) formed in the upper surface 14*a* of the main fuel tank 14 is closed by a filler cap 60.

The main fuel tank 14 is connected to the fuel injection unit 24 through the fuel supply pipe 16 exiting from its the bottom surface 14*b*. As shown in FIG. 7, the fuel supply pipe 16 is provided with, in order from the upstream side, a filter 62, the low-pressure pump (second fuel pump) 22, and the high-pressure pump module 20.

In the following, the section of the fuel supply pipe between the main fuel tank 14 and the high-pressure pump module 20 will be called the "low pressure section" and designated by the symbol 16*a*, and the section thereof between the high-pressure pump module 20 and the fuel injection unit 24 will be called the "high pressure section" and designated by the symbol 16*b*. In this specification, the terms "downstream" and "upstream" mean "in the direction of" and "in the direction opposite to" normal gasoline fuel flow.

The filter 62 removes foreign matter and other impurities from the gasoline fuel passing therethrough. The low-pressure pump 22 pumps gasoline fuel contained in the main fuel tank 14 to the high-pressure pump module 20 (more exactly, to a sub-fuel tank of the high-pressure pump module 20 explained later). The low-pressure pump 22 is a magnetic diaphragm pump. Its operation is controlled by the aforesaid ECU 53.

Figure 8:
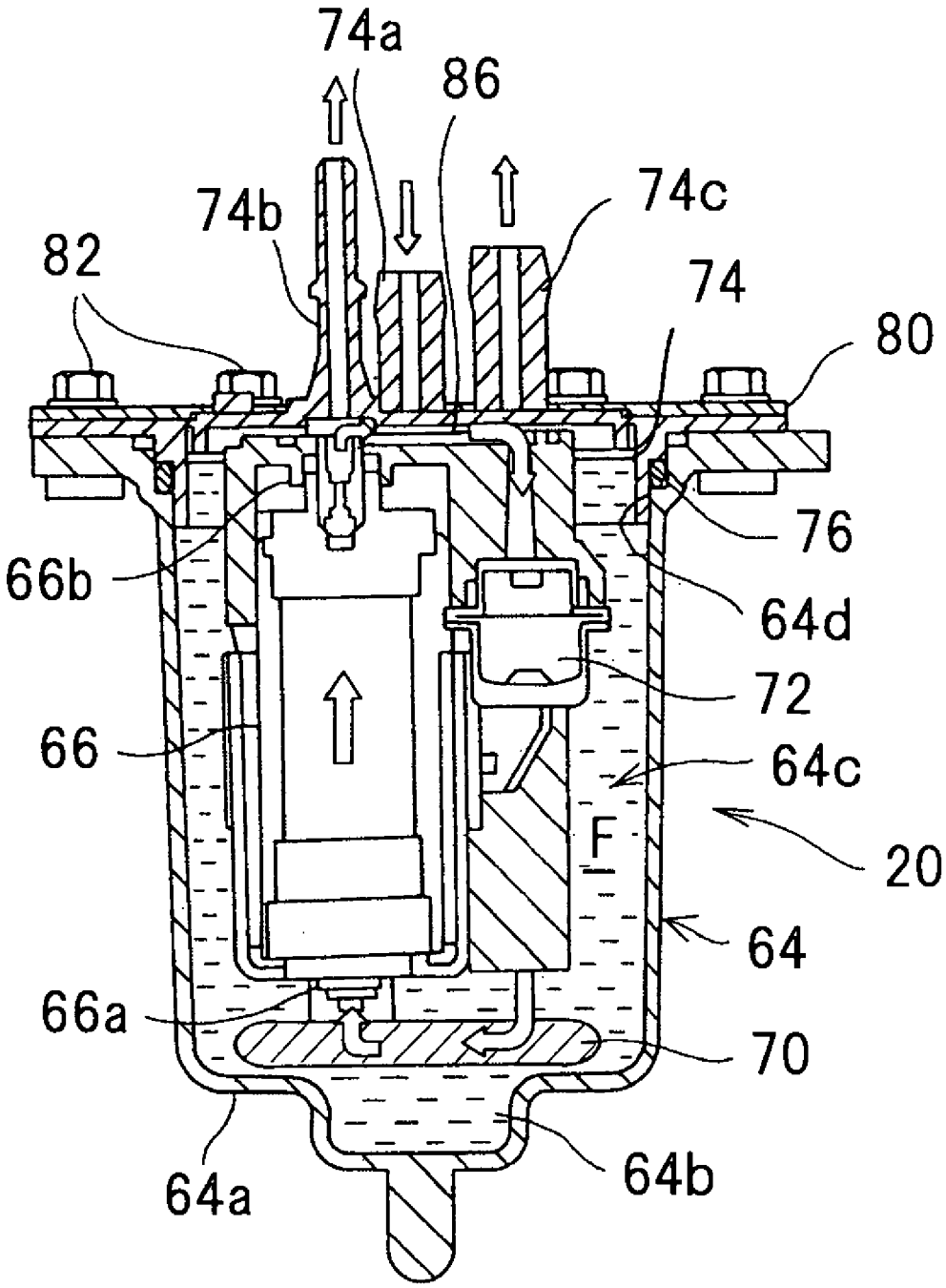
FIG. 8 is a partially sectional view showing the detailed structure of the high-pressure pump module shown in FIG. 7 and other drawings.
Figure 9:
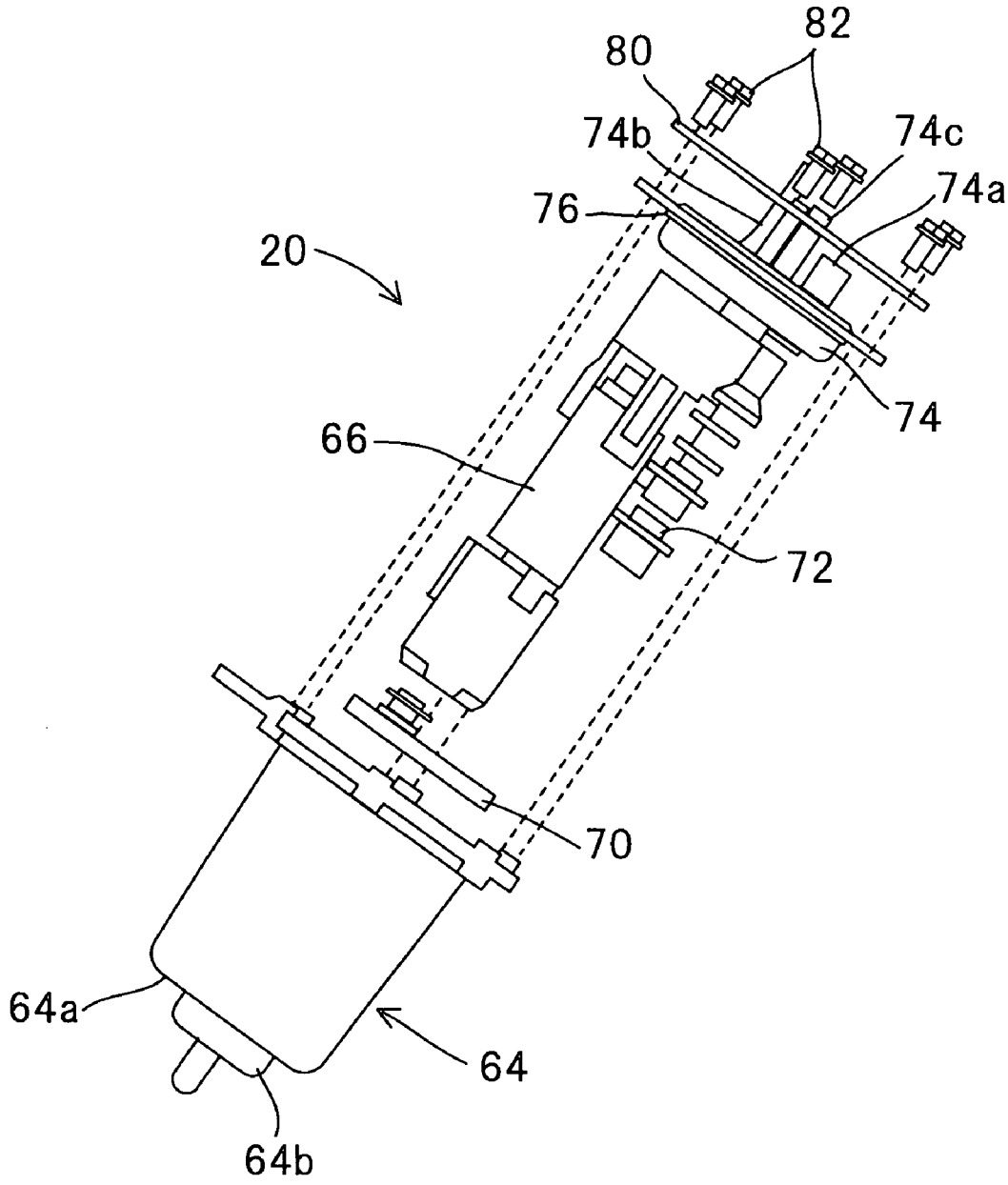
FIG. 9 is an exploded perspective view of the high-pressure pump module shown in FIG. 8.

FIG. 8 is a partially sectional view showing the detailed structure of the high-pressure pump module 20 shown in FIG. 7 and other drawings. FIG. 9 is an exploded perspective view of the high-pressure pump module 20 shown in FIG. 8.

As shown in FIGS. 8 and 9, the high-pressure pump module 20 comprises, among other members, a sub-fuel tank 64 for retaining fuel supplied from the main fuel tank 14, a high-pressure pump (first fuel pump) 66 housed in the sub-fuel tank 64, a suction filter 70 disposed near an inlet 66*a* of the high-pressure pump 66, a regulator 72 housed in the sub-fuel tank 64, and a top cover 74 covering the top of the sub-fuel tank 64.

The sub-fuel tank 64 is substantially cylindrical and is open at the top. As best shown in FIG. 8, the bottom 64*a* of the sub-fuel tank 64 is formed to have a recess 64*b* of suitable depth. As explained further later, water, foreign matter and other impurities contained in the gasoline fuel settle and accumulate in the recess 64*b*. The sub-fuel tank 64 is fabricated of aluminum, for example.

The interior of the sub-fuel tank 64 (interior space 64*c*) houses the high-pressure pump 66. The inlet 66*a* of the high-pressure pump 66 is located at the lower part (in the gravitational direction) of the sub-fuel tank 64 interior, more exactly, near the bottom 64*a* of the sub-fuel tank 64 at a position above the recess 64*b* of the sub-fuel tank 64. The suction filter 70 is attached at the inlet 66*a* to remove foreign matter and other impurities contained in the gasoline fuel passing therethrough.

The high-pressure pump 66 has an outlet 66*b* located at the upper part (in the gravitational direction) of the sub-fuel tank 64 interior. The high-pressure pump 66 pumps gasoline fuel F delivered from the sub-fuel tank 64 through the high pressure section 16*b* to the fuel injection unit 24 (more exactly, to the fuel injectors 50 of the fuel injection unit 24). The high-pressure pump 66 is an electric pump. Its operation is controlled by the ECU 53.

The sub-fuel tank 64 has an opening 64*d* over which the top cover 74 is detachably installed. The top cover 74 is formed with a low-pressure connection 74*a* for interconnecting the sub-fuel tank 64 and the low pressure section 16*a*, a high-pressure connection 74*b* for interconnecting the outlet 66*b* of the high-pressure pump 66 with the high pressure section 16*b*, and a fuel return connection 74*c* for interconnecting the sub-fuel tank 64 and a fuel return pipe or line 84 explained later.

The regulator 72 is housed in the sub-fuel tank 64. It is connected near the outlet 66*b* of the high-pressure pump 66 through a regulator passage 86. The regulator 72 adjusts the pressure of the gasoline fuel delivered by the high-pressure pump 66.

The sub-fuel tank 64 is covered by the top cover 74. An O-ring (sealing member) 76 is interposed between the opening 64*d* of the sub-fuel tank 64 and the coupling region of the top cover 74. A substantially disk-shaped plate 80 is overlaid on the upper surface of the top cover 74 and, as illustrated, the sub-fuel tank 64, top cover 74 and plate 80 are fastened together by a number of (six) bolts 82. The opening 64*d* of the sub-fuel tank 64 is thus sealed fluid-tight by the top cover 74, O-ring 76 and plate 80.

As shown in FIG. 7, the sub-fuel tank 64 is connected to the main fuel tank 14 at its upper surface 14*a* through the fuel return connection 74*c* and fuel return pipe 84. In other words, the interior space 64*c* of the sub-fuel tank 64 and the main fuel tank 14 are interconnected through the fuel return pipe 84.

As further shown in FIG. 7, the sub-fuel tank 64 of the high-pressure pump module 20 is located above the main fuel tank 14 with respect to the orientation of the engine 10 under normal operating conditions. The main fuel tank 14 is located below the sub-fuel tank 64 of the high-pressure pump module 20 with respect to the orientation of the apparatus under normal operating conditions. Normal operating conditions denotes the engine 10 oriented as shown in FIG. 4.

The main fuel tank 14 is connected at its upper surface 14*a* to the fuel return pipe 84 and through a charge passage 90 to the canister 26. The canister 26 is connected through a purge passage 92 to the air intake system (to the intake ports 36) of the engine 10. A purge control valve 94 constituted as an electromagnetic solenoid valve is installed in the purge passage 92. The opening of the purge passage 92 varies in accordance with the amount of current supplied to the solenoid of the purge control valve 94. Its operation is controlled by the ECU 53.

Based on the above-described configuration, gasoline fuel that vaporizes in the main fuel tank 14 passes through the charge passage 90 into the canister 26 to be charged therein. The vaporized fuel passing into the canister 26 (especially its hydrocarbon (HC) component) is adsorbed by an adsorbent (not visible in the drawings) present inside the canister 26. When the purge passage 92 is opened, the negative pressure of the engine air intake system (intake ports 36) desorbs the vaporized fuel adsorbed by the adsorbent and then purges the desorbed vaporized fuel by sucking it to the intake ports 36 of the engine 10 at a flow rate governed by the opening of the purge passage 92.

The operation of the so-configured fuel supply system 12 will now be explained with reference to FIG. 7.

The low-pressure pump 22 is operated to feed gasoline fuel from the main fuel tank 14 through the filter 62, where impurities are removed, the low pressure section 16*a* and the low-pressure connection 74*a* to the sub-fuel tank 64 of the high-pressure pump module 20, thereby filling the sub-fuel tank 64 with gasoline fuel. During this process, water, foreign matter and other impurities settle and accumulate in the recess 64*b* of the sub-fuel tank 64.

The gasoline fuel retained in the sub-fuel tank 64 is drawn into the inlet 66*a* of the high-pressure pump 66 through the suction filter 70. (The suction filter 70 and inlet 66*a* are not visible in FIG. 7.) Next, the high-pressure pump 66 pumps high-pressure gasoline fuel into the high pressure section 16*b* through the outlet 66*b* and high-pressure connection 74*b*. The pressure of the gasoline fuel is suitably regulated by the regulator 72.

The gasoline fuel pressure-regulated by the regulator 72 is supplied through the high pressure section 16*b* to the fuel injection unit 24. The gasoline fuel supplied through the high pressure section 16*b* is distributed to fuel injectors 50 by the delivery pipe 52 of the fuel injection unit 24. The fuel injectors 50 inject the gasoline fuel into the intake ports 36 to produce an air-fuel mixture.

Any gasoline fuel that the operation of the low-pressure pump 22 supplies to the sub-fuel tank 64 in excess of the volume of the sub-fuel tank 64 (excess fuel) is recirculated (returned) to the main fuel tank 14 through the fuel return connection 74*c* and fuel return pipe 84.

Thus, the fuel supply system of the engine 10 according to the first embodiment is equipped with the sub-fuel tank 64 that retains gasoline fuel supplied from the main fuel tank 14 and houses the high-pressure pump 66 in its interior. In other words, the high-pressure pump 66 is immersed in the gasoline fuel retained in the sub-fuel tank 64, so that if an air pocket should occur in the fuel supply pipe between the main fuel tank 14 and high-pressure pump 66 (low pressure section 16*a*), the air will be discharged from the sub-fuel tank 64 to the exterior through the fuel return pipe 84 etc., thereby ensuring that the high-pressure pump 66 does not draw in air. Since the fuel injectors 50 can therefore inject gasoline fuel immediately, starting performance is enhanced.

Owing to the fact that water, foreign matter and other impurities contained in the gasoline fuel settle to the bottom of the sub-fuel tank 64, namely into the recess 64*b*, the probability of impurities being supplied directly to the high-pressure pump 66 is diminished. Malfunction of the high-pressure pump 66 because of clogging and the like is therefore prevented.

The inlet 66*a* of the high-pressure pump 66 is located at the lower part (in the gravitational direction) of the sub-fuel tank 64 interior. Intake of air by the high-pressure pump 66 is therefore still more thoroughly prevented and starting performance further improved, because the inlet 66*a* of the high-pressure pump 66 is located at a low position, while air present in the sub-fuel tank 64 is discharged upwardly.

The fuel supply system is equipped with the fuel return pipe 84 that interconnects the main fuel tank 14 and sub-fuel tank 64, so that any gasoline fuel that the operation of the low-pressure pump 22 supplies to the sub-fuel tank 64 in excess of the volume of the sub-fuel tank 64 (excess fuel) is recirculated (returned) to the main fuel tank 14 through the fuel return pipe 84. The sub-fuel tank 64 can therefore be kept constantly filled with gasoline fuel.

The fuel supply system is equipped with the low-pressure pump 22 installed in the fuel supply pipe 16 on the upstream side of the sub-fuel tank 64. Fuel can therefore be reliably supplied from the main fuel tank 14 to the sub-fuel tank 64 regardless of the positional relationship between the main fuel tank 14 and sub-fuel tank 64, i.e., even if the main fuel tank 14 is located below the sub-fuel tank 64 in the gravitational direction.

The aforesaid effect can be obtained because the main fuel tank 14 is located lower than the sub-fuel tank 64 in the gravitational direction.

The engine 10 in the first embodiment is equipped with the fan cover 44 that encloses the cooling fan 42 for drawing in and blowing air to conduct cooling, and the fuel injection unit 24 for injecting fuel is located at a position close to the cooling fan 42, more specifically to the fan cover 44 (in the fan cover upper space 46), where the temperature is relatively low during operation and hot soaking of the engine 10. In other words, the fuel injection unit 24 is located in an environment where the effect of heat from the cylinders 32 and the like thereon is minimal. Due to this configuration, it is possible to prevent generation of vapor in the fuel supply pipe near the fuel injection unit 24 (e.g., the high pressure section 16*b*). The return pipe can therefore be omitted. The fuel pipe configuration in the vicinity of the fuel injection unit 24 is therefore simplified and freedom of piping layout is also enhanced. Another merit is that omission of the return pipe enables a proportional size reduction of the engine 10. In addition, the suppression of vapor generation improves the stability of fuel injection.

The engine 10 is equipped with a plurality of (two) cylinders 32 centered on the crankshaft 30 and oriented in a V-configuration, and the fuel injection unit 24 is installed at a position close to the V-shaped over-cylinder space 54 formed between the two cylinders 32. This configuration enables the fuel injection unit 24 and cylinders 32 to be connected by relatively short fuel supply pipes, whereby it becomes possible to reduce the area (heat-receiving area) of the fuel supply pipes that are located near the fuel injection unit 24 and exposed to heat from the cylinders 32, which reach a high temperature during engine operation. Generation of vapor in the fuel supply pipes near the fuel injection unit 24 can therefore be still more effectively inhibited.

The fuel injection unit 24 comprises the fuel injectors 50 installed one at each of the cylinders 32 and the delivery pipe 52 for delivering gasoline fuel from the fuel supply pipe (high pressure section 16*b*) to the fuel injectors 50. This configuration prevents generation of vapor in the delivery pipe 52 connected to the fuel injectors 50.

The fuel supply system is equipped with the high-pressure pump 66 installed in the fuel supply pipe 16 interconnecting the main fuel tank 14 and fuel injection unit 24 and with the low-pressure pump 22 installed in the fuel supply pipe 16 on the upstream side of the high-pressure pump 66. Due to this configuration, the prevention of generation of vapor in the delivery pipe 52 can be achieved even more markedly.

A fuel supply system 12*a* of the engine 10 according to a second embodiment of this invention will now be explained.

Figure 10:
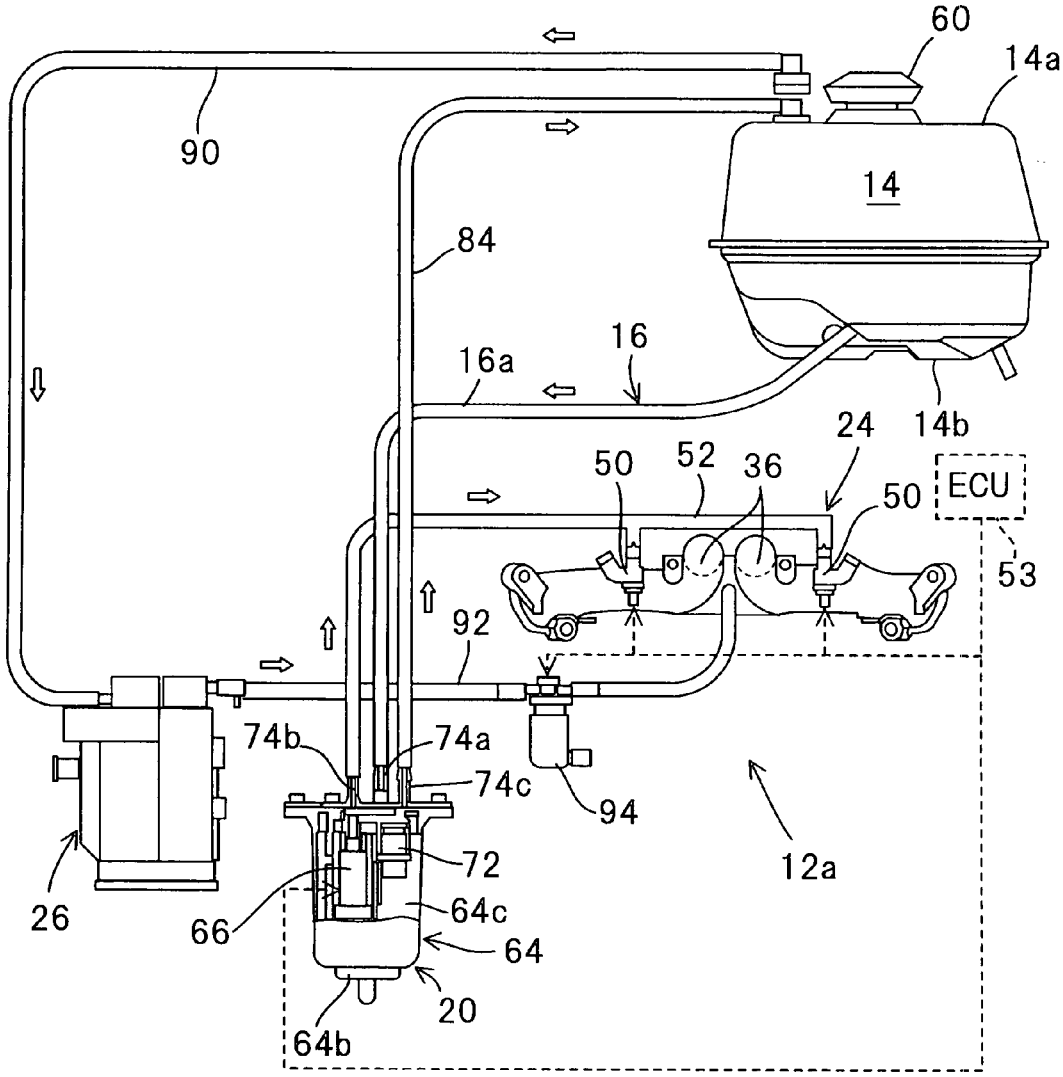
FIG. 10 is a schematic view, similar to FIG. 7, but showing the fuel supply system for a general purpose internal combustion engine according to the second embodiment of this invention.

FIG. 10 is a schematic view similar to that of FIG. 7 showing the fuel supply system 12*a* of the engine 10 according to the second embodiment of this invention. Constituents common with those of the first embodiment are assigned like reference symbols and will not be explained again.

The explanation will be made with focus on points differing from the first embodiment. In the second embodiment, the main fuel tank 14 is located above the sub-fuel tank 64 of the high-pressure pump module 20 in the gravitational direction, and the filter 62 and low-pressure pump 22 are omitted from the low pressure section 16*a*. (In FIG. 2, the main fuel tank 14 according to the second embodiment is represented by alternate long and short dash lines.) The operation of the fuel supply system 12*a* will now be explained.

Gasoline fuel descends from the main fuel tank 14 under its own weight to be retained in the sub-fuel tank 64 of the high-pressure pump module 20 located below in the gravitational direction. The flow and the like of the gasoline fuel retained in the sub-fuel tank 64 is the same as that explained regarding the first embodiment and will not be explained again here.

Any excess gasoline fuel supplied from the main fuel tank 14 to the sub-fuel tank 64 vaporizes (becomes vapor) and is recirculated to the main fuel tank 14 through the fuel return pipe 84.

Thus in the fuel supply system 12*a* of the engine 10 according to the second embodiment, the main fuel tank 14 is located upward (in the gravitational direction) of sub-fuel tank 64 of the high-pressure pump module 20, and the low-pressure pump 22 etc. of the first embodiment are omitted. Effects like those of the first embodiment can therefore be achieved with a simpler configuration than that of the first embodiment.

The first and second embodiments are thus configured to have a fuel supply system (12) for a general purpose internal combustion engine (10), having: a fuel tank (14) adapted to retain fuel of the engine; a fuel injection unit (24) including a fuel injector (50) to inject the fuel into an intake port (36) of a cylinder (32) of the engine; a fuel supply pipe (16) connecting the fuel tank and the fuel injection unit; and a fuel pump (high-pressure pump) (66) installed in the fuel supply pipe to pump and supply the fuel to the fuel injection unit; characterized by: a sub-fuel tank (64) adapted to retain the fuel supplied from the fuel tank, such that the fuel pump is housed in the sub-fuel tank.

In the system, the fuel pump (66) is housed in the sub-fuel tank (64) to be immersed in the fuel retained in the sub-fuel tank.

In the system, an inlet (66*a*) of the fuel pump (66) is located at a lower part in the sub-fuel tank (64).

The system further includes: a fuel return pipe (84) connecting the sub-fuel tank and the fuel tank.

The system further includes: a second fuel pump (low-pressure pump) (22) installed in the fuel supply pipe (16) at a location between the sub-fuel tank (64) and the fuel tank (14) to pump and supply the fuel to the sub-fuel tank.

In the system, the fuel tank (14) is located at a position lower than the sub-fuel tank (64).

In the system according to the second embodiment, the fuel tank (14) is located at a position higher than the sub-fuel tank (64).

The system further includes: a cooling fan (42) adapted to draw in and blow air; and the fuel injection unit (24) is located at a position close to the fan.

In the system, the engine (10) has a plurality of cylinders (32) centered on a crankshaft (30) and oriented in a V-configuration and the fuel injection unit (24) is installed at a position close to a V-shaped space (over-cylinder space) (54) formed between the cylinders.

In the system, the fuel injection unit (24) includes the fuel injectors (50) installed at the cylinders and a delivery pipe (52) delivering the fuel from the fuel supply pipe to the fuel injectors.

It should be noted in the above that, in the first embodiment electric power consumption can be reduced and low-emission operation achieved by operating the low-pressure pump 22 in accordance with fuel injection quantity of the engine 10, namely, by utilizing the ECU 53 to control the supply of gasoline fuel from the main fuel tank 14 to the sub-fuel tank 64 to the minimum sufficient quantity.

Japanese Patent Application Nos. 2006-222086 and 2006-222087 both filed on Aug. 6, 2006, are incorporated herein in its entirety.

While the invention has thus been shown and described with reference to specific embodiments, it should be noted that the invention is in no way limited to the details of the described arrangements; changes and modifications may be made without departing from the scope of the appended claims.

What is claimed is:

1. A fuel supply system for a general purpose internal combustion engine, said fuel system comprising:

a fuel tank adapted to retain fuel of the engine;

a fuel injection unit including a fuel injector to inject the fuel into an intake port of a cylinder of the engine;

a fuel supply pipe connecting the fuel tank and the fuel injection unit;

a fuel pump installed in-line with the fuel supply pipe to pump and supply the fuel to the fuel injection unit;

a sub-fuel tank adapted to retain the fuel supplied from the fuel tank, wherein the fuel pump is housed in the sub-fuel tank; and a fuel return pipe connecting the sub-fuel tank and the fuel tank, wherein the sub-fuel tank is configured and arranged to be constantly filled with fuel during operation thereof, and excess fuel is returned to the fuel tank via the fuel return pipe.

2. The fuel supply system according to claim 1, wherein the fuel pump housed in the sub-fuel tank is immersed in the fuel retained in the sub-fuel tank.

3. The fuel supply system according to claim 1, wherein an inlet of the fuel pump is located at a lower part in the sub-fuel tank.

4. The fuel supply system according to claim 1, further including:

a second fuel pump installed in-line with the fuel supply pipe at a location between the sub-fuel tank and the fuel tank to pump and supply the fuel to the sub-fuel tank.

5. The fuel supply system according to claim 4, wherein the fuel tank is located at a position lower than the sub-fuel tank.

6. The fuel supply system according to claim 1, wherein the fuel tank is located at a position higher than the sub-fuel tank.

7. The fuel supply system according to claim 1, further including:

a cooling fan adapted to draw in and blow air, wherein the fuel injection unit is located at a position close to the fan.

8. The fuel supply system according to claim 1, wherein the engine has a plurality of cylinders centered on a crankshaft and oriented in a V-configuration and the fuel injection unit is installed at a position close to a V-shaped space formed between the cylinders.

9. The fuel supply system according to claim 8, wherein the fuel injection unit includes the fuel injectors installed at the cylinders and a delivery pipe delivering the fuel from the fuel supply pipe to the fuel injectors.

10. A fuel supply system for a general purpose internal combustion engine, said fuel system comprising:

a fuel tank adapted to retain fuel of the engine;

a fuel injection unit including a fuel injector to inject the fuel into an intake port of a cylinder of the engine;

a fuel supply pipe connecting the fuel tank and the fuel injection unit;

a first fuel pump installed in-line with the fuel supply pipe to pump and supply the fuel to the fuel injection unit;

a sub-fuel tank adapted to retain the fuel supplied from the fuel tank, wherein the first fuel pump is housed in the sub-fuel tank, further including a second fuel pump installed in-line with the fuel supply pipe at a location between the sub-fuel tank and the fuel tank to pump and supply the fuel to the sub-fuel tank; and a fuel return pipe connecting the sub-fuel tank and the fuel tank, wherein the sub-fuel tank is configured and arranged to be constantly filled with fuel during operation thereof, and excess fuel is returned to the fuel tank via the fuel return pipe.

11. The fuel supply system according to claim 1, wherein the sub-fuel tank has a recess at its bottom end which collects impurities.

12. The fuel supply system according to claim 1, wherein the sub-fuel tank has a suction filter therein, located proximate a fuel inlet of the fuel pump.

13. A fuel supply system for a general purpose internal combustion engine, said fuel system comprising:

a main fuel tank adapted to retain fuel for the engine;

a fuel injection unit including a fuel injector configured to inject the fuel into an intake port of a cylinder of the engine;

a fuel supply pipe operatively connecting the main fuel tank and the fuel injection unit;

a high-pressure fuel pump installed in-line with the fuel supply pipe for supplying fuel to the fuel injection unit;

a sub-fuel tank adapted to retain the fuel supplied from the fuel tank, the sub-fuel tank having a low-pressure fuel inlet, a low-pressure fuel outlet and a high-pressure fuel outlet thereon, wherein the low-pressure fuel outlet is disposed at an upper end of the sub-fuel tank, and wherein the high-pressure fuel pump is housed in the sub-fuel tank;

a low-pressure fuel pump for supplying fuel to the sub-fuel tank, the low-pressure fuel pump installed in-line with the fuel supply pipe at a location between the main fuel tank and the sub-fuel tank; and a fuel return pipe connecting the sub-fuel tank and the main fuel tank, wherein the sub-fuel tank is configured and arranged to be substantially entirely filled with fuel during operation thereof, and excess fuel is returned to the fuel tank via the fuel return pipe.

14. The fuel supply system according to claim 13, wherein an inlet of the high-pressure fuel pump is located at a lower part of the sub-fuel tank.

15. The fuel supply system according to claim 13, further comprising a cooling fan adapted to draw in and blow air, wherein the fuel injection unit is located at a position close to the fan.

16. The fuel supply system according to claim 13, wherein the engine has a plurality of cylinders centered on a crankshaft and oriented in a V-configuration, and the fuel injection unit is installed at a position close to a V-shaped space formed between the cylinders.

17. The fuel supply system according to claim 13, wherein the sub-fuel tank has a recess at its bottom end which collects impurities.

18. The fuel supply system according to claim 13, wherein the sub-fuel tank has a suction filter therein, located proximate a fuel inlet of the high-pressure fuel pump.

* * * * *